US005948926A

United States Patent [19]

Takeo et al.

[11] Patent Number: 5,948,926

[45] **Date of Patent: *Sep. 7, 1999**

[54] METHOD FOR INHIBITING OXIDATION OF OILS AND FATS OR FATTY ACIDS

[75] Inventors: Hiroyuki Takeo; Masaaki Sugino; Hideto Yamamoto; Takeshi Matsuo, all of Hyogo; Yoshihiro Ohhata; Isao Takayanagi, both of Saitama, all of Japan

[73] Assignees: NOF Corporation; Shiseido Company, Ltd., both of Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/385,128

[22] Filed: Feb. 7, 1995

[30] Foreign Application Priority Data

Feb. 7, 1994 [JP] Japan ..... 6-035420

[51] Int. Cl.[6] ..... C11B 5/00

[52] U.S. Cl. ..... 554/7; 554/2; 554/198; 554/199; 252/397; 252/399; 252/404; 252/407

[58] Field of Search ..... 554/2, 7, 198, 554/199; 252/397, 399, 404, 407

[56] References Cited

U.S. PATENT DOCUMENTS 4,352,746 10/1982 Bracco et al. ..... 252/398

OTHER PUBLICATIONS

Sang et al., Oleagineux, vo. 39(2), pp. 89–98, 1984.
Voudouri et al., FSTA abstract, 79(05): N0217, 1979.

*Primary Examiner*—Gary Geist
*Assistant Examiner*—Deborah D Carr
*Attorney, Agent, or Firm*—Sughrue, Mion, Zinn, Macpeak & Seas, PLLC

[57] ABSTRACT

A method for inhibiting the oxidation of oils and fats or fatty acids which comprises adding an antioxidant and an oxyacid having an average particle size of 200 $\mu$m or less to said oils and fats or fatty acids. According to this method, the oxyacid is easily dispersed or dissolved in said oils and fats or fatty acids, and the oxidation inhibiting effect is remarkably improved without deteriorating the quality of the oils and fats or fatty acids.

18 Claims, No Drawings

METHOD FOR INHIBITING OXIDATION OF OILS AND FATS OR FATTY ACIDS

FIELD OF THE INVENTION

This invention relates to a method for inhibiting oxidation of oils and fats or fatty acids, and more particularly to a method for inhibiting oxidation which comprises adding an antioxidant together with an oxyacid as a synergist to oils and fats or fatty acids, wherein the oxyacid is added in the form of a finely divided grain.

BACKGROUND OF THE INVENTION

When oils and fats or articles of food containing oils and fats are oxidized, unpleasant odors are generated and peroxides are formed which exert undesirable effects on the human body. In addition, although fatty acids and their derivatives obtained from of animal or plant sources oils and fats are used in many industrial fields because of their surface-modifying functions, lubrication functions and physiological activities, fatty acids, especially unsaturated fatty acids, tend to undergo oxidation which causes coloring of fatty acids and the formation of peroxides that generate unpleasant odors. Fatty acids and their derivatives changed in quality by degradation of such peroxides are not desirable as materials for food, cosmetics, pharmaceutical drugs and the like.

Antioxidants are generally used to prevent oxidation of oils arid fats or fatty acids. In an oxygen-contacting system, however, the oxidation inhibiting effect does not last long because of rapid consumption of the antioxidant. Addition of an antioxidant in a large quantity (500 ppm or more) to strengthen its oxidation inhibiting effect is not desirable because it causes side reactions. For example, in the process of soap production, soap often develops an undesirable color when prepared by saponification.

Consequently, in order to minimize the amount of antioxidant while simultaneously improving the oxidation inhibiting effect, concurrent use of a synergist is generally practiced. Examples of synergists having an oxidation inhibition function include oxyacids, phosphoric acid and derivatives thereof, various amino acids and derivatives thereof, flavone derivatives, sulfur compounds and the like, of which oxyacids are most widely used.

German Patent Publication No. 2,038,468 discloses a process for the purification of fatty acids in which oxyacids are added to fatty acids and then distilled. This process, however, is insufficient to inhibit the oxidation of fatty acids. Also, because they have a low solubility in oils and fats or fatty acids, oxyacids are generally added in the form of aqueous or alcohol solution to oils and fats or fatty acids, water or alcohol is sufficiently removed by distillation under reduced pressure and then excess crystalized oxyacids are removed. This method, however, is not advantageous from an industrial point of view due to the reduction in quality of oils and fats or fatty acids caused by the solvent remaining after distillation, as well as the considerable time and labor required for carrying out these operation steps.

In addition, the use of ester derivatives of oxyacids with monoglycerides has been proposed and practiced with the aim of increasing their solubilities in oils and fats or fatty acids. However, the effects of such ester derivatives are insufficient and they are expensive as compared to oxyacids. Techniques for dispersing oxyacid solutions making use of surface active agents and the like have also been practiced. However, such surface active agents, solvents and the like become impurities in the oils and fats or fatty acids and reduce the quality of the resulting products.

SUMMARY OF THE INVENTION

In view of the above, an object of the present invention is to provide a method for inhibiting the oxidation of oils and fats or fatty acids which comprises adding both an antioxidant and an oxyacid to said oils and fats or fatty acids. In this method, the oxyacid is dispersed or dissolved by a simple operation without reducing the qualities of the oils and fats or fatty acids, to thereby remarkably improve the oxidation inhibiting effect.

With the aim of achieving the above object, the present inventors have conducted extensive studies and found that the dispersibility or solubility of oxyacids in oils and fats or fatty acids is remarkably increased when the oxyacid in the form of finely divided particles is added concurrently with an antioxidant. The present invention has been accomplished on the basis of this finding.

Accordingly, the present invention relates to a method for inhibiting oxidation of oils and fats or fatty acids which comprises adding an antioxidant and an oxyacid having an average particle size of 200 $\mu$m or less to said oils and fats or fatty acids. According to this method, oxyacids are easily added and the oxidation inhibition effect is remarkably improved without degrading the quality of oils and fats or fatty acids.

Other objects and advantages of the present invention will be apparent from the following detailed description.

DETAILED DESCRIPTION OF THE INVENTION

Examples of the oils and fats for use in the present invention include beef tallow, milk fat, lard, palm oil, palm kernel oil, coconut oil, soybean oil, rapeseed oil, cotton seed oil, safflower oil, linseed oil, sunflower oil, olive oil, rice oil, corn oil, tung oil, camellia oil, fish oil, jojoba oil and hydrogenated, bleached, dried and distilled oils and fats thereof. Examples of fatty acids for use in the present invention include those which are obtained by hydrolyzing animal and plant oils, such as tallow fatty acid, lard fatty acid, milk fat fatty acid, palm oil fatty acid, palm kernel oil fatty acid, soybean oil fatty acid, rapeseed oil fatty acid, coconut oil fatty acid, cotton seed oil fatty acid, safflower oil fatty acid, linseed oil fatty acid, sunflower oil fatty acid, olive oil fatty acid, rice oil fatty acid, corn oil fatty acid, tung oil fatty acid, camnellia oil fatty acid, fish oil fatty acid, jojoba oil fatty acid, and hydrogenation-refined, bleached, dried and deodorized fatty acids thereof, as well as free fatty acids obtained by solid-liquid separation or fractional distillation of the above fatty acids, such as oleic acid, linoleic acid, erucic acid, linolenic acid, lauric acid, myristic acid, palmitic acid and stearic acid.

The antioxidant for use in the present invention is not particularly limited, and synthetic antioxidants such as phenol antioxidants and amine antioxidants and natural antioxidants can generally he used. Examples of the phenol antioxidant include 4,4'-methylenebis(2,6-di-t-butyl-phenol), 2,6-di-t-butyl-p-cresol, 1,6-hexanediolbis-3-(3,5-di-t-butyl-4-hydroxyphenol)propionate, t-butylhydroxyanisole, 4,4'-butylidenebis(3-methyl-6-t-butylphenol), 4,4'-thiobis(3-methyl-6-t-butylpenol), esters of gallic acid and the like. Examples of the amine base antioxidant include ethoxquin (6-ethoxy-1,2-dihydro-2,2,4-trimethylquinoline), N,N-diphenyl-p-phenylenediamine, phenyl-β-naphthylamine and the like. Examples of the natural antioxidant include tocopherol, flavonoid derivatives, guaiac resin and nordihydroguaiaretic acid.

Of these antioxidants, t-butylhydroxyanisole, 2,6-di-t-butyl-p-cresol and tocopherol are particularly preferred.

These antioxidants may be used in an amount of preferably from 1 to 500 ppm based on the weight of the oils and fats or fatty acids, more preferably from 10 to 300 ppm based on the weight of the oils and fats or from 10 to 200 ppm based on the weight of the fatty acids.

Examples of the oxyacid for use in the present invention include lactic acid, citric acid, tartaric acid, malic acid, ascorbic acid, mandelic acid, salicylic acid, tartronic acid and glycolic acid, of these, tartaric acid, citric acid, ascorbic acid and malic acid are particularly preferred. According to the present invention, these oxyacids are formed into finely divided particles having an average particle size of 200 μm or less, preferably 100 μm or less, which may be effected either by wet grinding or dry grinding. Wet grinding is desirable for the purpose of preventing secondary aggregation after grinding. When dry grinding is employed, it is desirable to disperse the finely divided oxyacid in an appropriate dispersion medium using a dispersion machine, and then adding the dispersion to the oils and fats or fatty acids.

When wet grinding is employed, it is desirable to use oils and fats or fatty acids, especially those to which the oxyacid is added, as the dispersion medium. The grinding machine is not particularly limited, and includes a sand mill, a bead mill and a media mill. Illustrative examples of the grinding machine include the Pearl Mill and Super Mill manufactured by Ashizawa Ltd., the Sand Mill, Media Mill and Super Mill manufactured by Inoue Seisakusho K.K. and Attritor and the Bead Mill and My Mill manufactured by Mitsui miike Machine Co., Ltd. With regard to the construction material of the grinding mill, ceramic or ceramic-coated materials are preferred. The concentration of the oxyacid in the dispersion medium at the time of grinding may be in the range of from 1 to 40% by weight, preferably from 10 to 30% by weight.

According to the present invention, when the thus finely divided oxyacid is added together with the aforementioned antioxidant to oils and fats or fatty acids, the oxyacid is easily dispersed or dissolved in the oils and fats or fatty acids. As a result, the oxidation inhibition effect is improved while avoiding the problems of the prior art such as coloring due to the use of a large amount of antioxidant and quality reduction due to contamination by impurities. The thus finely divided oxyacid may be added to oils and fats or fatty acids in an amount of preferably from 50 to 1,000 ppm, more preferably from 200 to 800 ppm based on the weight of the oils, fats or fatty acids.

Thus, according to the present invention, a finely divided oxyacid and an antioxidant are both added to oils and fats or fatty acids. As a result, the oxyacid is easily added to oils and fats or fatty acids and a remarkable increase in the oxidation inhibition effect is obtained without causing coloring, quality reduction and the like problems.

EXAMPLES

The following Examples are provided to further illustrate the present invention. It is to be understood, however, that these Examples are for the purpose of illustration only, and are not to be construed as limiting the invention.

In the following Examples, each oxyacid was used in the form of a dry-ground powder (dry-ground into a predetermined particle size using a Jet Mill manufactured by Nippon Pneumatic Mfg. Co., Ltd. as a dry grinding machine) or wet-ground powder (wet-ground into a predetermined particle size in an amount of 20% by weight in a dispersion medium using a Pearl Mill manufactured by Ashizawa Ltd. as a wet grinding machine and palm oil fatty acid as the dispersing medium), and the particle size of each oxyacid was measured using a Microtrack manufactured by Nikkisou Co., Ltd.

Inventive Example 1

A 50 ppm portion of t-butylhydroxyanisole and 500 ppm of tartaric acid finely wet-ground to have an average particle size of 50 μm were added to palm oil fatty acid (neutralization value: 207.5, iodine value: 5:3.2) which had been obtained by distilling palm oil-hydrolyzed fatty acid. The mixture was stored at 80° C. in the presence of air and its peroxide value was measured periodically in accordance with Standard Oil and Fat Analytical Method JOCS (Official and Tentative Methods of the Japan Oil Chemist's Society) 2.4.12-86. After an 8-day storage period, the fatty acid was made into soap in the manner described below, to conduct a soap color measurement and a DEA coloring test (Diethanolamine heat color stability test). The results are shown in Tables 1 (Peroxide value) and 2 (Color of soap and DEA coloring test).

<Soap Color Measurement>

The fatty acid sample was mixed with an equimolar amount of sodium hydroxide aqueous solution (28% by weight), kneaded using a double arm mill, dried to a water content of about 15% by weight, compressed with a plodder and then molded using a soap press. Whiteness (W) and yellowness (b) of the thus obtained soap were measured using a SM color computer manufactured by Suga Test Instruments Co., Ltd.

<DEA Coloring Test>

The fatty acid sample was mixed with an equimolar amount of diethanolamine and ethanol, the mixture was allowed to react for 20 minutes in a boiling water bath, and then the hue of the resulting sample was measured in accordance with the APHA method (Standard Oil and Fat Analytical Method JOCS 2.3.2.5-71). When the hue exceeded APHA 500, it was measured in accordance with the Gardner method (Standard Oil and Fat Analytical Method JOCS 2.3.1.3-71).

Comparative Example 1

Palm oil-hydrolyzed fatty acid (neutralization value: 207.5, iodine value: 53.2) was distilled in the same manner as described in Inventive Example 1, and 50 ppm of t-butylhydroxyanisole was added to the resulting palm oil fatty acid. The mixture was stored at 80° C. in the presence of air and its peroxide value was measured in the same manner as described in Inventive Example 1. After an 8-day storage period, the fatty acid was made into soap to conduct a soap color measurement and DEA coloring test in the same manner as described in Inventive Example 1. The results are shown in Tables 1 and 2.

Comparative Example 2

Palm oil-hydrolyzed fatty acid was distilled in the same manner as described in Inventive Example 1, and t-butylhydroxyanisole was added in an amount of as much as 500 ppm to the resulting palm oil fatty acid (neutral value: 207.5, iodine value: 53.2). The mixture was stored at 80° C. in the presence of air, and its peroxide value was measured in the same manner as described in Inventive Example 1. After an 8-day storage period, the fatty acid was made into soap to conduct a soap color measurement and DEA coloring test in the same manner as described in Inventive Example 1. The results of these tests are shown in Tables 1 and 2.

Inventive Example 2

Beef tallow-hydrolyzed fatty acid was distilled to obtain tallow fatty acid, (neutralization value: 205.4, iodine value:

52.7) to which was subsequently added 50 ppm of 2,6-di-t-butyl-p-cresol and 500 ppm of tartaric acid. The tartaric acid had been finely divided to have an average particle size of 100 μm by dry grinding. The resulting mixture was stored at 80° C. in the presence of air, and its peroxide value was measured in the same manner as described in Inventive Example 1. After an 8-day storage period, the fatty acid sample was made into soap to conduct a soap color measurement and DEA coloring test in the same manner as described in Inventive Example 1. The results are shown in Tables 1 and 2.

Inventive Example 3

Crude oleic acid of palm oil was distilled to obtain palm oil oleic acid (neutralization value: 199.1, iodine value: 90.8), to which were subsequently added 50 ppm of 4,4'-methylenebis(2,6-di-t-butylphenol) and 500 ppm of citric acid. The citric acid had been finely divided to have an average particle size of 20 μm by wet grinding. The resulting mixture was stored at 80° C. in the presence of air, and its peroxide value was measured in the same manner as described in Inventive Example 1. After an 8-day storage period, the fatty acid was made into soap to conduct a soap color measurement and DEA coloring test in the same manner as described in Inventive Example 1. The results of these tests are shown in Tables 1 and 2.

Comparative Example 3

Crude oleic acid of palm oil was distilled in the same manner as described in Inventive Example 3. To this were added 50 ppm of 4,41'-methylenebis(2,6-di-t-butylphenol) and 500 ppm of unground citric acid having an average particle size of 350 μm. The mixture was stored at 80° C. in the presence of air, and its peroxide value was measured in the same manner as described in Inventive Example 1. After an 8-day storage period, the fatty acid sample was made into soap to conduct a soap color measurement and DEA coloring test in the same manner as described in Inventive Example 1. The results are shown in Tables 1 and 2.

Inventive Example 4

Palm kernel oil-hydrolyzed fatty acid was distilled to obtain palm kernel oil fatty acid (neutralization value: 252.3, iodine value: 18.0), to which were subsequently added 50 ppm of tocopherol and 500 ppm of ascorbic acid. The ascorbic acid had been finely divided to have an average particle size of 50 μm by wet grinding. The resulting mixture was stored at 80° C. in the presence of air and its peroxide value was measured in the same manner as described in Inventive Example 1. After all 8-day storage period, the fatty acid sample was made into soap to conduct a soap color measurement and DEA coloring test in the same manner as described in Inventive Example 1. The results are shown in Tables 1 and 2.

Inventive Example 5

Palm oil-hydrolyzed fatty acid (neutralization value: 206.8, iodine value: 52.5) was subjected to hydrogenation at 160–200° C. under a hydrogen pressure of 3 atmospheric pressures in the presence of a nickel catalyst to reduce the iodine value by 10 and then distilled. The resulting palm oil fatty acid was mixed with 50 ppm of 2,6-di-t-butyl-p-cresol and 500 ppm of citric acid which had been finely divided by dry grinding to have an average particle size of 50 μm. The mixture was stored at 80° C. in the presence of air, and its peroxide value was measured in the same manner as described in Inventive Example 1. The results are shown in Table 1 below.

After an 8-day storage period, the fatty acid sample was made into soap to conduct a soap color measurement and the DEA coloring test in the same manner as described in Inventive Example 1. The results are shown in Table 2 below.

In order to evaluate the stability of soap, the fatty acid sample just after preparation was made into a soap in the same manner as described in Inventive Example 1. The thus prepared soap, packaged with a polyethylene bag (Unipack manufactured by Seisannihonsha Co. Ltd. ) and aged at 40° C. to measure the change with time of the whiteness (W) and yellowness (b) using an SM color computer (manufactured by Suga Test Instruments Co., Ltd.) The results are shown in Table 3 below.

Comparative Example 4

The same palm oil-hydrolyzed fatty acid (neutralization value: 206.8, iodine value: 52.5) as used in Inventive Example 5 was treated and mixed with 2,6-di-t-butyl-p-cresol and citric acid in the same manner as described in Inventive Example 5 except that the citric acid used was an unground one having an average particle size of 350 μm. The mixture was stored at 80° C. in the presence of air and its peroxide value was measured in the same manner as described in Inventive Example 1. The results are shown in Table 1 below.

After an 8-day storage period, the fatty acid sample was made into soap to conduct a soap color measurement and the DEA coloring test in the same manner as described in Inventive Example 1. The results are shown in Table 2 below.

In order to evaluate the stability of soap, the fatty acid sample just after preparation was made into a soap in the same manner as described in Invention Example 1. The thus prepared soap was packaged and aged to measure the change with time of the whiteness (W) and yellowness (b) in the same manner as described in Inventive Example 1. The results are shown in Table 3 below.

TABLE 1

| | just after | Peroxide value (milliequivalent/kg) After storage for: | | | | | |
|---|---|---|---|---|---|---|---|
| | preparation | 2 days | 4 days | 6 days | 8 days | 10 days | 12 days |
| Inventive Example 1 | 0.1 | 0.2 | 0.2 | 0.5 | 0.8 | 1.0 | 1.8 |
| Comparative Example 1 | 0.1 | 2.1 | 4.8 | 7.0 | 9.1 | 13.5 | 28.0 |
| Comparative Example 2 | 0.1 | 0.2 | 0.2 | 0.4 | 0.6 | 0.9 | 1.3 |
| Inventive Example 2 | 0.1 | 0.2 | 0.3 | 0.5 | 0.8 | 1.5 | 2.9 |
| Inventive Example 3 | 0.1 | 0.2 | 0.2 | 0.4 | 0.6 | 0.9 | 1.2 |
| Comparative Example 3 | 0.1 | 1.6 | 3.8 | 5.4 | 7.0 | 10.5 | 18.5 |
| Inventive Example 4 | 0.1 | 0.2 | 0.2 | 0.2 | 0.5 | 0.7 | 1.3 |
| Inventive Example 5 | 0.1 | 0.2 | 0.3 | 0.3 | 0.7 | 1.0 | 1.6 |
| Comparative Example 4 | 0.1 | 1.2 | 2.5 | 3.1 | 5.2 | 8.8 | 11.2 |

TABLE 2

| | Color of soap | | DEA coloring test | |
|---|---|---|---|---|
| | Whiteness (W) | Yellowness (b) | APHA method | Gardner method |
| Inventive Example 1 | 88 | 4 | 180 | — |
| Comparative Example 1 | 75 | 8 | 500+ | G5 |
| Comparative Example 2 | 75 | 9 | 500+ | G5 |
| Inventive Example 2 | 88 | 4 | 180 | — |
| Inventive Example 3 | 91 | 3 | 150 | — |
| Comparative Example 3 | 78 | 8 | 500+ | G4 |
| Inventive Example 4 | 89 | 3 | 160 | — |
| Inventive Example 5 | 92 | 3 | 150 | — |
| Comparative Example 4 | 80 | 8 | 500+ | G4 |

TABLE 3

| | | Color of soap | | | | |
|---|---|---|---|---|---|---|
| | | Just after | After storage for: | | | |
| | | preparation | 4 days | 8 days | 12 days | 16 days |
| Inventive Example 5 | Whiteness (W) | 95 | 94 | 92 | 88 | 84 |
| | Yellowness (b) | 3 | 3 | 4 | 5 | 6 |
| Comparative Example 4 | Whiteness (W) | 95 | 87 | 79 | 74 | 67 |
| | Yellowness (b) | 3 | 7 | 11 | 14 | 18 |

Inventive Example 6

A 200 ppm portion of t-butylhydroxyanisole and 500 ppm of tartaric acid which had been finely divided to have an average particle size of 50 μm by wet grinding were added to purified palm oil. The CDM test (oxidation stability test) in accordance with Standard Oil and Fat Analytical Method JOCS 2.4.28.2-93 was conducted. The results are shown in Table 4.

Comparative Example 5

Only a 200 ppm portion of t-butylhydroxyanisole was added to the same purified palm oil as used in Inventive Example 6. The CDM test was conducted in the same manner as described in Inventive Example 6. The results are shown in Table 4.

Comparative Example 6

A 200 ppm portion of t-butylhydroxyanisole and 500 ppm of unground tartaric acid having an average particle size of 350 μm were added to the same purified palm oil as used in Inventive Example 6. The CDM test was conducted in the same manner as described in Inventive Example 6. The results are shown in Table 4.

TABLE 4

| | CDM test (Hr) |
|---|---|
| Inventive Example 6 | 63 |
| Comparative Example 5 | 10 |
| Comparative Example 6 | 15 |

Thus, the results of the fatty acid oxidation stability tests conducted in Inventive Examples 1 to 5 and Comparative Examples 1 to 4 (the peroxide value, color of soap and DEA coloring test of Tables 1 and 2) and the oil and fat oxidation stability tests conducted in Inventive Example 6 and Comparative Examples 5 and 6 (the CDM test of Table 4), show that the method of the present invention is excellent in inhibiting oxidation of oils and fats or fatty acids, and does not cause problems such as coloring at the time of formation of derivatives such as soap. Therefore, the present invention provides an industrially useful method for inhibiting oxidation.

The excellent oxidation inhibiting effect obtained by the method of the present invention is mainly based on the good dispersibility of finely divided oxyacids in oils and fats or fatty acids. This is confirmed by the following dispersibility test in which ascorbic acid was used as the oxyacid and palm oil fatty acid was used as the dispersion medium.

<Dispersibility Test>

Samples of ascorbic acid used in the test were of unground commercially available ascorbic acid having an average particle size of 350 μm. The following 4 ground samples having particle sizes of 100 μm or less were prepared by subjecting the above commercial product to dry or wet grinding.

Dry grinding sample 1: average particle size 70 μm

Dry grinding sample 2: average particle size 40 μm

Wet grinding sample 1: average particle size 20 μm

Wet grinding sample 2: average particle size 5 μm

A 500 ppm portion of each of the above unground sample and 4 ground samples was added to palm oil fatty acid, and its dispersing or dissolving state was observed under a gently stirred condition (adjusted to 300 rpm using a turbine blade having a diameter of about ½ that of the vessel) to evaluate its dispersibility or solubility based on the following criterion. The results are shown in Table 5.

○: Perfectly clear liquid showing sufficient dissolution

Δ: Cloudy liquid showing dispersion but insufficient dissolution

X: Precipitation in the bottom showing almost no dispersion

TABLE 5

| | Inventive Samples* | | | | Comparative Sample |
|---|---|---|---|---|---|
| Average particle size (μm) | Dry 1 about 70 | Dry 2 about 40 | Wet 1 about 20 | Wet 2 about 5 | unground about 350 |
| Dispersibility after: | | | | | |
| 0 hr | Δ | Δ | Δ | Δ | X |
| 0.5 hr | Δ | Δ | ○ | ○ | X |
| 1 hr | Δ | ○ | ○ | ○ | X |

TABLE 5-continued

| | Inventive Samples* | | | | Comparative Sample |
|---|---|---|---|---|---|
| Average particle size (μm) | Dry 1 about 70 | Dry 2 about 40 | Wet 1 about 20 | Wet 2 about 5 | unground about 350 |
| 3 hrs | ○ | ○ | ○ | ○ | X |
| 6 hrs | ○ | ○ | ○ | ○ | X |
| 24 hrs | ○ | ○ | ○ | ○ | X |

*Dry means dry grinding; and Wet means wet grinding.

The results of Table 5 show that the ground oxyacid has excellent dispersibility or solubility as compared to the unground sample. Additionally, dispersibility or solubility is further improved as the average particle size of the oxyacid is decreased by wet-grinding.

While the invention has been described in detail and with reference to specific examples thereof, it will be apparent to one skilled in the art that various changes and modifications can be made therein without departing from the spirit and scope thereof.

What is claimed is:

1. A method for inhibiting oxidation of fatty acids which comprises adding to said fatty acids (1) an antioxidant selected from the group consisting of t-butylhydroxy-anisole and 2,6-di-t-butyl-p-cresol and (2) an oxyacid selected from the group consisting of tartaric acid, citric acid and malic acid having an average particle size of 200 μm or less wherein the average particle size of the oxyacid is obtained by grinding, and the oxyacid which is added to said fatty acids is in the form of a dry powder.

2. The method for inhibiting oxidation of fatty acids according to claim 1, wherein the oxyacid having an average particle size of 200 μm or less is prepared by grinding in a dispersion medium of fatty acids.

3. The method for inhibiting oxidation of fatty acids according to claim 1, wherein said antioxidant is added to the fatty acids in an amount of from 1 to 500 ppm.

4. The method for inhibiting oxidation of fatty acids according to claim 1, wherein said antioxidant is added to the fatty acids in an amount of from 10 to 300 ppm.

5. The method for inhibiting oxidation of fatty acids according to claim 1, wherein said antioxidant is added to the fatty acids in an amount of from 10 to 200 ppm.

6. The method for inhibiting oxidation of fatty acids according to claim 1, wherein said oxyacid is added in an amount of from 50 to 2,000 ppm.

7. The method for inhibiting oxidation of fatty acids according to claim 1, wherein said oxyacid is added to the fatty acids in an amount of from 100 to 1,000 ppm.

8. The method for inhibiting oxidation of fatty acids according to claim 1, wherein said oxyacid has an average particle size of 100 μm or less.

9. The method for inhibiting oxidation of fatty acids according to claim 1, wherein said oxyacid has an average particle size of 70 μm or less.

10. The method for inhibiting oxidation of fatty acids according to claim 1, wherein said oxyacid has an average particle size of 40 μm or less.

11. The method for inhibiting oxidation of fatty acids according to claim 1, wherein said oxyacid has an average particle size of 20 μm or less.

12. The method for inhibiting oxidation of fatty acids according to claim 1, wherein said oxyacid has an average particle size of from 5 to 100 μm.

13. The method for inhibiting oxidation of fatty acids according to claim 1, wherein said oxyacid has an average particle size of from 5 to 40 μm.

14. The method for inhibiting oxidation of fatty acids according to claim 1, wherein said oxyacid has an average particle size of from 5 to 20 μm.

15. The method for inhibiting oxidation of fatty acids according to claim 1, wherein said oxyacid having an average particle size of 200 μm or less is prepared by dry grinding.

16. A mixture that is stable to oxidation comprising (A) a fatty acid, (B) an antioxidant and (C) an oxyacid, wherein said oxyacid has an average particle size of 200 μm or less and is dispersed in said fatty acid wherein the average particle size of the oxyacid is obtained by grinding, and the oxyacid which is added to said fatty acids is in the form of a dry powder.

17. The mixture of claim 16, wherein said oxyacid has an average particle size of 100 μm or less.

18. The mixture of claim 16, wherein said oxyacid has an average particle size of 40 μm or less.

* * * * *